US010641474B2

(12) United States Patent
Zhu

(10) Patent No.: US 10,641,474 B2
(45) Date of Patent: May 5, 2020

(54) LIGHT STRING AND MANUFACTURING METHOD THEREOF

(71) Applicant: Ganzhou SHANGJIE Technologies Co., Ltd., Ganzhou (CN)

(72) Inventor: Jianjun Zhu, Huizhou (CN)

(73) Assignee: GANZHOU SHANGJIE TECHNOLOGIES CO., LTD., Ganzhou (CN)

( * ) Notice: Subject to any disclaimer, the term of this patent is extended or adjusted under 35 U.S.C. 154(b) by 29 days.

(21) Appl. No.: 16/260,005

(22) Filed: Jan. 28, 2019

(65) Prior Publication Data

US 2019/0234597 A1 Aug. 1, 2019

(30) Foreign Application Priority Data

Jan. 31, 2018 (CN) ..... 2018 1 0098261

(51) Int. Cl.

| | |
|---|---|
| ***F21S 4/00*** | (2016.01) |
| ***F21V 23/00*** | (2015.01) |
| ***F21S 4/10*** | (2016.01) |
| ***F21V 23/02*** | (2006.01) |
| ***F21V 23/06*** | (2006.01) |
| ***F21V 19/00*** | (2006.01) |
| *F21Y 115/10* | (2016.01) |
| *F21Y 113/13* | (2016.01) |
| *F21Y 103/10* | (2016.01) |

(52) U.S. Cl.

CPC ..... *F21V 23/002* (2013.01); *F21S 4/10* (2016.01); *F21V 19/003* (2013.01); *F21V 23/023* (2013.01); *F21V 23/06* (2013.01); *F21Y 2103/10* (2016.08); *F21Y 2113/13* (2016.08); *F21Y 2115/10* (2016.08)

(58) Field of Classification Search

CPC combination set(s) only.
See application file for complete search history.

(56) References Cited

U.S. PATENT DOCUMENTS

2013/0088868 A1* 4/2013 Slowinski ..... F21V 7/00 362/247
2018/0017248 A1* 1/2018 Athauda ..... A41D 27/085

FOREIGN PATENT DOCUMENTS

| | | |
|---|---|---|
| CN | 101526182 A | 9/2009 |
| CN | 101532617 A | 9/2009 |
| CN | 107084330 A | 8/2017 |

* cited by examiner

*Primary Examiner* — Minh D A
(74) *Attorney, Agent, or Firm* — Hemisphere Law, PLLC; Zhigang Ma

(57) ABSTRACT

A light string includes at least two conductor wires each covered with an insulating coating defining plural holes acting as electrical bare spots, a controller with an input terminal connected to an external power supply and an output terminal electrically connected to the at least two conductor wires, and plural light sources. Each light source includes one or more LEDs and a circuit board having a first surface used for fixing the one or more LEDs and a second surface defining at least two conductive strips across the second surface. The at least two conductive strips are electrically connected to the at least two conductor wires through the electrical bare spots, respectively. Each connecting part between the conductive strips and the conductor wires is wrapped around by a light transmissive glue. Two conductive ends of each LED are electrically connected to two of the at least two conductive strips.

10 Claims, 5 Drawing Sheets

LIGHT STRING AND MANUFACTURING METHOD THEREOF

BACKGROUND OF THE INVENTION

1. Field of the Invention

The present invention relates to decorative light strings, and more particularly to a light string and its manufacturing method.

2. Description of Related Art

Light strings are widely applied in various lighting decoration occasions, such as Christmas trees, squares, trees, etc. If color flicker is expected to be realized on the existing light string, a control chip is generally provided for each light source, and then the light source is performed with functional control by technologies of two power lines plus one control line or two power line carrier. The light source is generally formed as a bulb or an independent light bead. When the wires are connected with the light sources, the wires are required to be cut into segments connected between every two light bulbs or light heads, which has high cost, low production efficiency, and is not easy for automatic production.

BRIEF DESCRIPTION OF THE SEVERAL VIEWS OF THE DRAWING(S)

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

The invention will now be described in detail through several embodiments with reference to the accompanying drawings.

Figure 1:
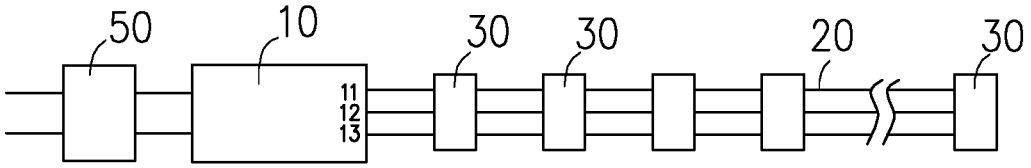
FIG. 1 is a schematic diagram showing a circuit structure of a light string according to an embodiment of the present invention.
Figure 2A:
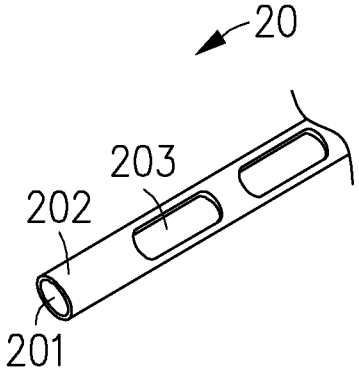
FIG. 2A is a perspective view of a part of a enameled conductor wire having plural of bare spots.
Figure 2B:
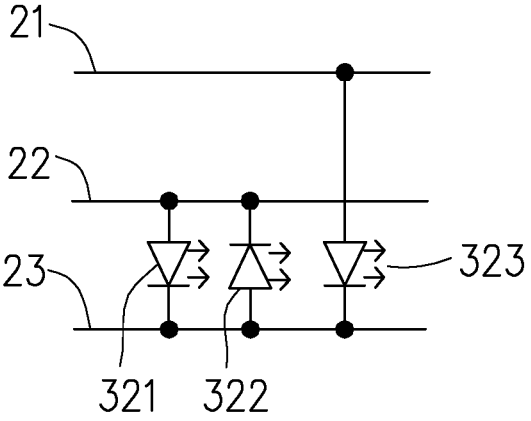
FIG. 2B is a schematic diagram showing a circuit structure of a light source of a light string according to a first embodiment of the present invention.
Figure 3A:
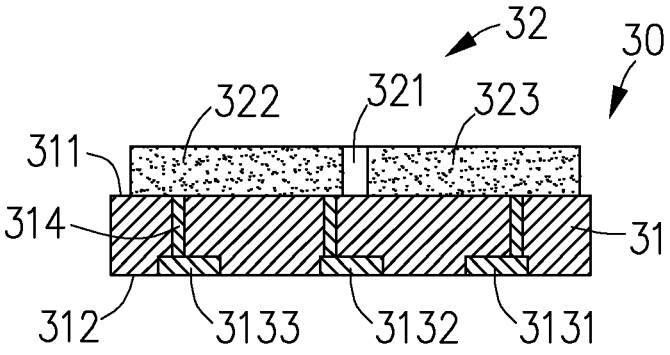
FIG. 3A is a cross-sectional view of the light source of the light string according to the first embodiment of the present invention.
Figure 3B:
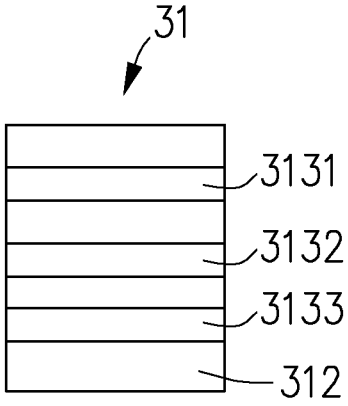
FIG. 3B is a back view of a circuit board of the light source in FIG. 3A.

As shown in FIGS. 1 to 3, in accordance to a first embodiment, a light string of the present invention mainly includes a controller 10, three enameled conductor wires 20 electrically connected to an output terminal of the controller 10, and a plurality of light sources 30 electrically connected to the enameled conductor wires 20 and spaced apart. An input terminal of the controller 10 may be electrically connected to a power adapter 50 to provide a stable power supply voltage for the controller 10, and the power adapter 50 may be matched with a mains socket or other powder socket by a plug or a two-wire plug.

The conductor wires 20 may be copper wires, aluminium wires, nickel wires, or other available enameled wires, in the embodiment, they are copper wires 201. Each copper wire 201 is covered with an insulating coating 202, in the embodiment, insulated only with varnish to form the insulating coating. The insulating coating 202 on each conductor wire defines many holes 203 exposing the copper wire 201 in the air, these exposed area through the holes 203 acts as electrical bare spots (labeled also as 203 in FIG. 2A). These holes 203 in the insulating coating 202 should arranged in a line along the conductor wire 20. Hereinafter, the three enameled conductor wires 20 is referred as a first conductor wire 21, a second conductor wire 22 and a third conductor wire 23.

The controller 10 has three output pins hereinafter referred as a first output pin 11, a second output pin 12 and a third output pin 13. The first output pin 11, the second output pin 12 and the third output pin 13 are mechanically and electrically connected to ends of the first conductor wire 21, the second conductor wire 22 and the third conductor wire 23, respectively. The controller 10 is configured to control the voltage output to the three conductor wires 20, thereby controlling the light-emitting states of the plurality of light sources 30 for various light-emitting effects such as flicker, discoloration, and the like.

Referring to FIGS. 2 and 3, in the first embodiment, the light source 30 includes a circuit board 31 and three light emitting diodes 32 (hereinafter, simply referred to as LED) in different colors, for example but not limited red, blue and green, respectively, fixed to the circuit board 31. For convenience of description, the three LEDs 32 are defined as a first LED 321, a second LED 322, and a third LED 323, respectively.

The circuit board 31 is a printed circuit board (PCB) having a first surface 311 used for fixing the LEDs 32 and a second surface 312 opposite to the first surface 311. The second surface 312 includes three conductive strips 3131, 3132, 3133 across the second surface 312. The conductive strips 3131, 3132, 3133 are physically and electrically non-connected, and are respectively soldered and electrically connected to the conductor wires 21, 22, 23 through the electrical bare spots 203, respectively. In this embodiment, the three conductive strips 3131, 3132, 3133 are bare copper regions, each having a rectangular strip shape through opposite sides of the second surface 312 of the circuit board 31, and substantially parallel with the the second surface 312. In other embodiments, the bare copper of the three conductive strips 3131, 3132, 3133 may be printed with solder. In other embodiments, the three conductive strips 3131, 3132, 3133 may also be recessed relative to the second surface 312. The three conductive strips 3131, 3132, 3133 are respectively soldered and electrically connected to the first conductor wire 21, the second conductor wire 22 and the third conductor wire 23, respectively.

The first LED 321 and the second LED 322 are in an inverse-parallel connection between the second conductor wire 22 and the third conductor wire 23 via the conductive strips 3132, 3133, respectively, and a positive electrode of the first LED 321 is connected to the second conductor wire 22. The third LED 323 is connected between the third conductor wire 23 and the first conductor wire 21 via the conductive strips 3131, 3133, respectively, and a positive electrode of the third LED 323 is connected to the first conductor wire 21. Thus, when the first output pin 11 of the controller 10 is at a high level and the third output pin 13 is in a low level, the third LED 323 emits light, while the other two do not emit light. If the first output pin 11 of the controller 10 is at the high level, the third output pin 13 is at the low level, and the second output pin 12 is at the high level, the third LED 323 and the first LED 321 emit light and output the mixed light of both. If the first output pin 11 of the controller 10 is at the high level, the third output pin 13 is at the high level, and the second output pin 12 is at the low level, the third LED 323 and the first LED 321 do not emit light, but the second LED 322 emits light. Thus seven light emitting effects may be realized by changing the voltage level of the three conductor wires 20, so that rich change effects may then be realized by changing the output frequency of the voltage level and the change law of the voltage level.

Each connecting part between the conductive strips 3131, 3132, 3133 and the conductor wires 21, 22, 23 is wrapped around by a light transmissive glue 40. In the embodiment, the light transmissive glue 40 is wrapped around the whole light source 30 and the conductor wires 20 therebelow (see FIG. 4, for convenience of observation, secontion lines for the light transmissive glue 40 are omitted).

Three LEDs 32 is wire bonded (pressure welding, also known as bonding, linking, or wire welding) to the first surface 311 of the circuit board 31, and the position of the LED bonding wire corresponding to the circuit board is also sealed and fixed by glue so that the LED and the circuit board are referred as an independent light source component. FIG. 3A is a cross-sectional view of the light source 30, the cross-sectional direction being the direction in which the three conductive strips 313 are cut laterally, that is, the cutting direction is perpendicular to the extending direction of the conductive strips 313, and the two LEDs 323, 322 are cut away. FIG. 3A shows three conductive paths 314 in the circuit board 31, the two paths 314 on the left side of the figure conduct electricity for LED 322 and the conductive strips 3132, 3133. The conductive path on the right side of the figure conducts electricity for the LED 323 and the conductive strip 3131. The conductive paths for the LED 321 on the rear side of the figure and another conductive path for the LED 323 on the right side of the figure are not in the cross-section, and are therefore not shown.

Figure 4:
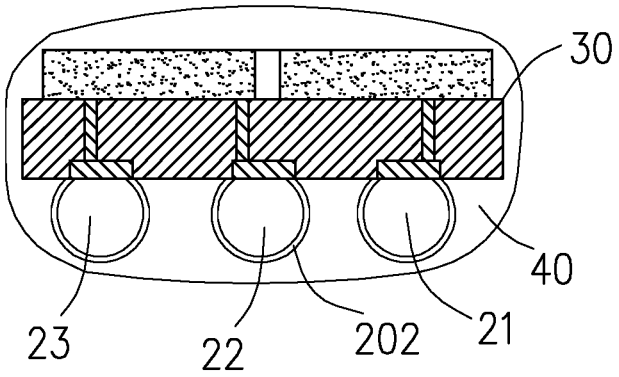
FIG. 4 is a cross-sectional view of the light string according to the first embodiment of the present invention, showing three copper wires, a light source, and a light transmissive glue.

FIG. 4 is a cross-sectional view of the light string, showing the conductor wires 21, 22, 23, a light source 30, and light transmissive glue 40. In FIG. 4, for the convenience of observation, the shadow lines of the conductor wires and the light transmissive glue are eliminated, and the light transmissive glue fills the space enclosed by the outer ring in FIG. 4, thereby ensuring the direct insulation of the three conductor wires. The enameled conductor wires used in this embodiment need to be polished before the circuit board 31 of the light source 30 is electrically connected to the conductor wires, so that an insulating coating 25 of a portion (only the portion facing toward the circuit board) of the conductor wires to be connected to the circuit board is polished off, and then the polished conductor wire is welded to the conductive strip of the circuit board 31, and finally the light source 30 and the conductor wire portion connected to the light source 30 are wrapped by the light transmissive glue 40. This ensures connection stability between the light source and the conductor wire, and the light transmissive glue may be regarded as the optical processing element of LED for forming effects of light bead. In other embodiment, the insulating coating of the preset regions may be removed by laser.

Figure 5:
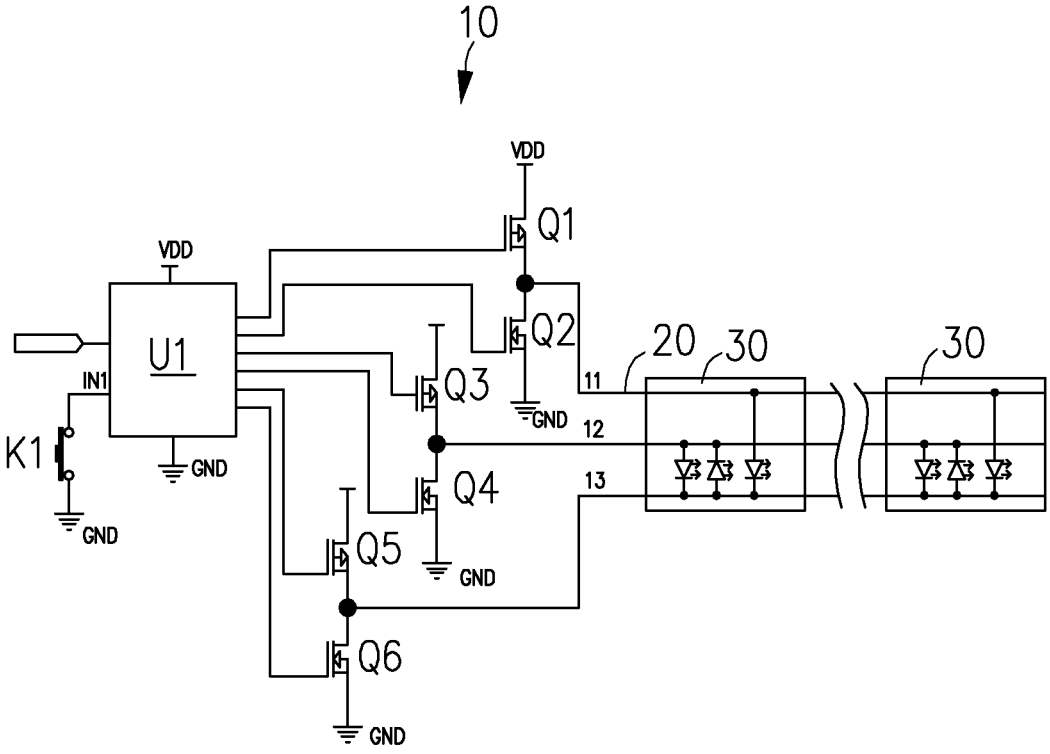
FIG. 5 is a schematic diagram showing a circuit structure of a controller of the light string according to the first embodiment of the present invention.

Referring to FIG. 5, in this embodiment, the controller 10 includes a control chip U1, a switch K1, and six triodes Q1, Q2, Q3, Q4, Q5, and Q6. Three (Q2, Q4, Q6) of the six triodes are PNP-type triodes and the other three (Q1, Q3, Q5) are NPN-type triodes. The control chip U1 has an input pin IN1 connected to the switch K1, a power supply terminal VDD connected to the power supply output pin of the power adapter 50, and a ground terminal GND connected to the ground terminal of the power adapter 50. The controller 10 also has six output pins respectively connected to base electrodes of the six triodes. The six triodes are divided into three groups, and each group includes a PNP-type triode and an NPN-type triode, wherein an collector of the NPN-type triode is connected to the power supply terminal VDD of the control chip U1, an emitter electrode thereof is electrically connected to the collector of the PNP-type triode and one of the three conductor wires 20, and the emitter electrode of the PNP-type triode is connected to the ground terminal GND of the control chip U1. Thus, when the six output pins of the control chip U1 output corresponding high or low levels of the controllable triodes, the three conductor wires 20 are electrically connected to the power supply terminal VDD of the control chip U1 or to the ground terminal GND of the control chip U1, so as to have different voltages for on-off control over the three LED 32 lights. The control chip U1 may also have other input pins. The manufacturer can change the control program of the chip by one of the input pins, input the remote control codes by the other input pin IN2 shown in the figure, and control the voltage output by the output pin of the chip so as to achieve different control. The user can switch different control function by controlling the switch K1. In other embodiments, the triode may also be integrated into the control chip U1, thereby making the controller 10 more compact.

Figure 6:
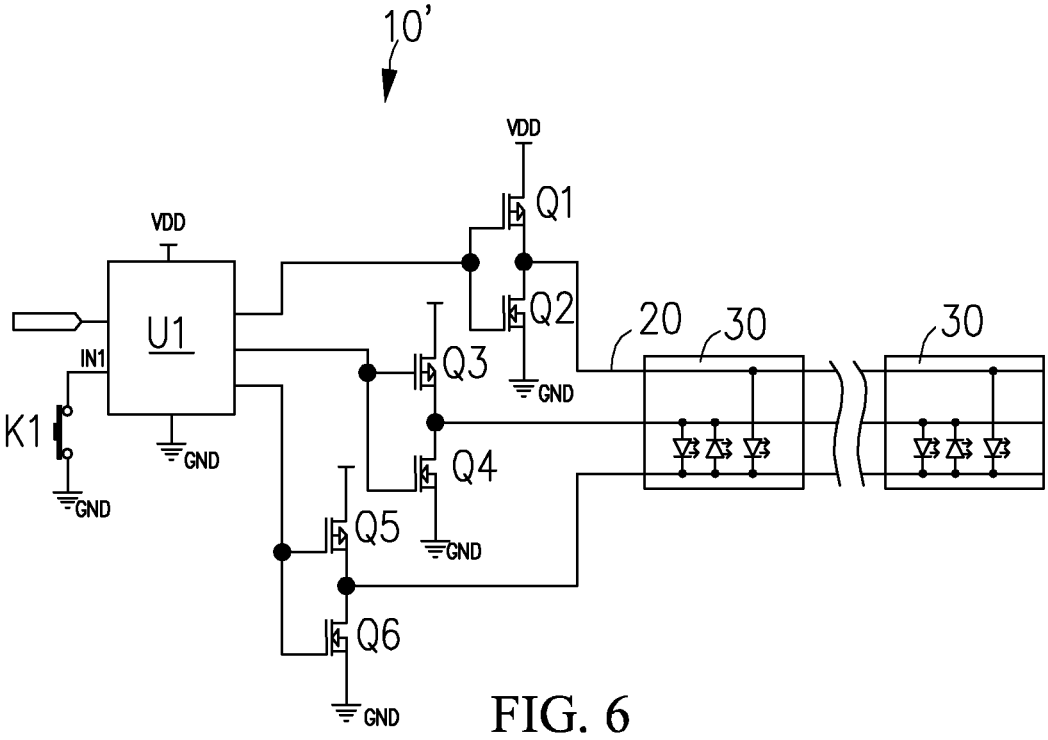
FIG. 6 is a schematic diagram showing a circuit structure of a controller of a light string according to a second embodiment of the present invention.

Referring to FIG. 6, in a second embodiment, similar components to the first embodiment are numbered identically, the controller 10' includes a control chip U1, a switch K1, and six triodes Q1, Q2, Q3, Q4, Q5, and Q6. Three (Q2, Q4, Q6) of the six triodes are PNP-type triodes and the other three (Q1, Q3, Q5) are NPN-type triodes. The control chip U1 has an input pin IN1 connected to the switch K1, a power supply terminal VDD connected to the power supply output of the power adapter 50, and a ground terminal GND connected to the ground terminal of the power adapter 50. The difference is that the controller 10' has only three output pins. The six triodes are divided into three groups, and each group includes a PNP-type triode and an NPN-type triode, wherein the base electrode of the NPN-type triode is connected to the base electrode of the PNP-type triode and to one of the output pins of the control chip U1, and the collector of the NPN triode is connected to the power supply terminal VDD of the control chip U1, the emitter electrode thereof is electrically connected to the collector of the PNP triode and one of the three conductor wires 20, and the emitter electrode of the PNP triode is connected to the ground terminal GND of the control chip U1. Thus, when the three output pins of the control chip U1 output corresponding high or low levels of the controllable transistor, the three conductor wires 20 are either electrically connected to the power supply terminal VDD of the control chip U1, or to the ground terminal GND of the control chip U1, so as to have different voltages for on-off control over the three LED 32. The control chip U1 may also have other input pins. The manufacturer can change the control program of the chip by one of the input pins, input the remote control codes by the other input pin IN2 shown in the figure, and control the voltage output by the output pin of the chip so as to achieve different control. The user can switch different control function by controlling the switch K1.

Figure 7:
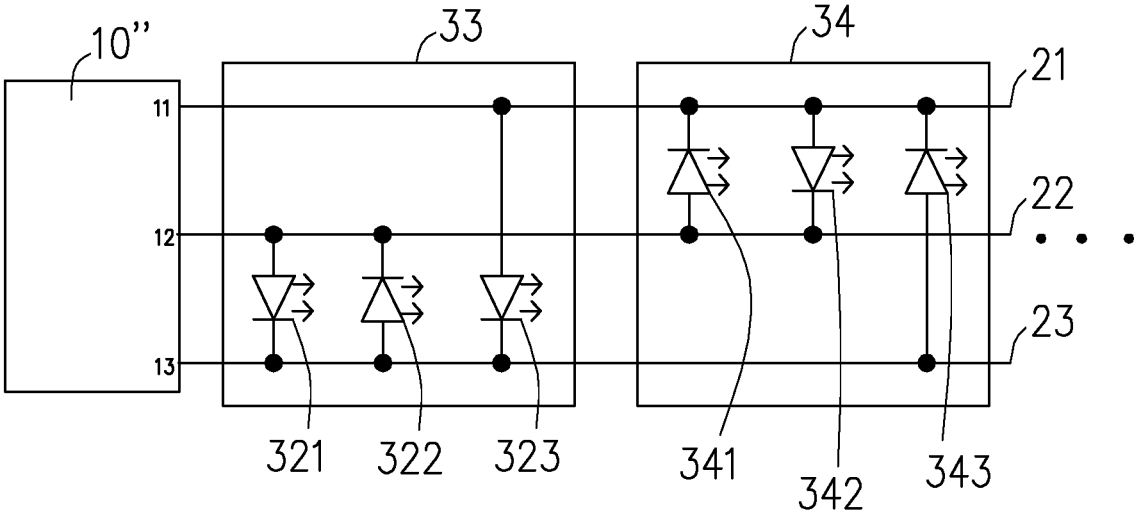
FIG. 7 is a schematic diagram showing a circuit structure of a light string according to a third embodiment of the present invention.

Referring to FIG. 7, in a third embodiment, the light string mainly includes a controller 10", three enameled conductor wires 21, 22, 23 electrically connected to the output pins 11, 12, 13 of the controller 10", a plurality of light sources 33, 34 electrically connected to three enameled conductor wires and spaced apart, and a light transmissive glue wrapped around each light source and the conductor wire therebelow. In this embodiment, the controller 10" is the same as the controller 10 in the first embodiment or the controller 10' in the second embodiment. The three enameled conductor wires 21, 22, 23 are the same as the conductor wires 21, 22, 23 in the first embodiment. The plural light sources 33 are the same as the light sources 30 in the first embodiment. Each of the plural light sources 34 includes a fourth LED 341, a fifth LED 342 and a sixth LED 343. The fourth and the fifth LEDs 341, 342 are in an inverse-parallel connection between the first conductor wire 21 and the second conductor wire 22, and the sixth LED 343 is connected between the third conductor wire 23 and the first conductor wire 21. And the third LED 323 and the sixth LED 343 are in an inverse-parallel connection between the third conductor wire 23 and the first conductor wire 21. In the embodiment, the plural first light sources 33 and the plural second light sources 34 are arranged alternately. In other words, all the light sources are divided into a lot of groups arranged side by side, and each group has one light source 33 and one light source 34.

In operation, when the output pin 11 of the controller 10" is at a high level and the output pin 13 is at a low level, the LED 323 of the light source 33 is turned on; when the output pin 11 is at a low level, and the output pin 13 is at a high level, the LED 343 of the light source 34 is turned on; when the output pin 13 is at a high level, and the output pin 12 is at a low level, the LED 322 of the light source 33 is turned on; when the output pin 11 is at a high level, and the output pin 12 is at a low level, the LED 342 of the light source 34 is turned on; when the output pin 12 is at a high level, and the output pin 13 is at a low level, the LED 321 of the light source 33 is turned on; and when the output pin 12 is at a high level, and the output pin 11 is at a low level, and the LED 341 of the light source 34 is turned on.

By setting the voltage change frequency output by the controller 10", people will feel that all the LEDs are turned on when each LED is turned on one by one in a short time (the lighting frequency exceeds the resolution of the human eye). By setting the voltage change frequency output by the controller 10", people will feel that all the LEDs are turned on and off in a rotate pattern when the LEDs are turned on one by one in a short time (the lighting frequency does not exceed the resolution of the human eye). Therefore enabling various lighting modes.

In other embodiments, the same technical effects as in the first embodiment may also be achieved after a plurality of light sources 34 are connected to the controller 10.

Figure 8:
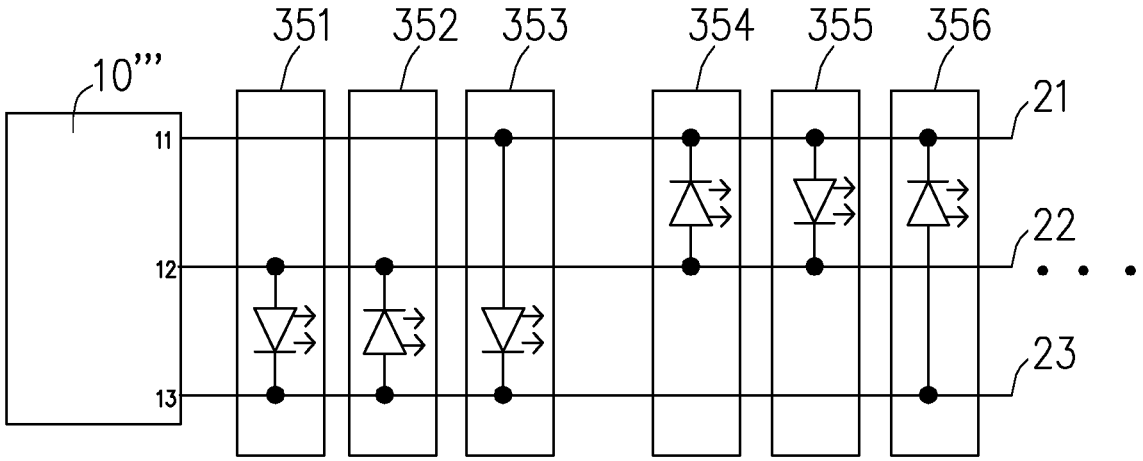
FIG. 8 is a schematic diagram showing a circuit structure of a light string according to a fourth embodiment of the present invention.

Referring to FIG. 8, in a fourth embodiment, the light string mainly includes a controller 10'", three enameled conductor wires 21, 22, 23 electrically connected to the output pins 11, 12, 13 of the controller 10'", and a plurality of light sources 351, 352, 353, 354, 355, 356. The light sources 351, 352, 353, 354, 355, 356 are electrically connected to the three enameled conductor wires and spaced apart, and a light transmissive glue wrapped around each light source and the conductor wire therebelow. In this embodiment, the controller 10'" is the same as the controller 10 in the first embodiment or the controller 10' in the second embodiment. The three enameled conductor wires 21, 22, 23 are the same as the conductor wires 21, 22, 23 in the first embodiment. The difference between the light sources 351, 352, 353, 354, 355, 356, et al. in the fourth embodiment and the light source 30 in the first embodiment is that each light source includes a circuit board similar to the circuit board 31 in the first embodiment, and one LED connected to the circuit board. The only one LED is electrically connected to two of the three conductive strips of the circuit board. By properly arranging the light sources 351, 352, 353, 354, 355, 356, a circuit structure and its function of the fourth embodiment may be equivalent to those in the first and third embodiments.

In a deformation embodiment of the fourth embodiment, each light source may include a circuit board similar to the circuit board 31 in the first embodiment, and two LEDs connected to the circuit board. By properly arranging the light sources, a circuit structure and its function of the fourth embodiment may be equivalent to those in the first and third embodiments.

Figure 9:
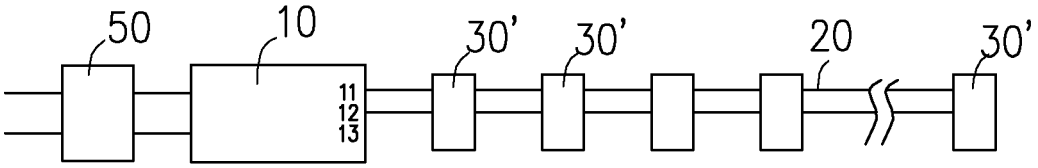
FIG. 9 is a schematic diagram showing a circuit structure of a light string according to a fifth embodiment of the present invention.

Referring to FIG. 9, in a fifth embodiment, the light string mainly includes a controller 10, two enameled conductor wires 20 electrically connected to the output pins 11, 12 of the controller 10, and a plurality of light sources 30'. Each light sources 30' includes a circuit board and one or two LEDs connected to the circuit board. The circuit board is a printed circuit board (PCB) having a first surface used for fixing the one or two LEDs and a second surface opposite to the first surface. The second surface includes two conductive strips across the second surface. The two conductive strips are physically and electrically non-connected, and are respectively soldered and electrically connected to the two enameled conductor wires, respectively. The one or two LEDs are electrically connected to the two enameled conductor wires via the two conductive strips of the circuit board. By properly arranging the light sources, various lighting modes may be realized.

In other embodiments, the triode may also be integrated into the control chip U1, thereby making the controller 10 more compact.

In other embodiments, the triodes of FIGS. 5 and 6 may be replaced with field effect transistors for the same switching function. Specifically, the PNP-type triode is replaced with a P channel field effect transistor, and the NPN-type triode is replaced with an N channel field effect transistor. Similarly, in a variant, the control chip may be integrated with the field effect transistor to become an independent chip, making the controller more compact.

The enameled conductor wire is used in the above embodiment, and the insulating paint is an acetal paint. In other embodiments, other types of copper wires coated with an insulating layer on the surface, such as copper wires coated with a resin having high heat resistance, copper wires coated with paraffin, or polyester enameled wires, polyurethane enameled wires, polyamide imide enameled wire, etc. may be adopted.

In other embodiments, the input terminal of the controller may be electrically connected to a socket or plug matched with other plugs or sockets for series connection of a plurality of light strings. In this embodiment, the power adapter supplies power to the controller; in other embodiments, the controller may include a power circuit capable of converting the mains supply to the direct current so as to provide a stable high voltage (e.g., 5V or 3V) for the power supply terminal of the control chip.

In the above embodiment, one or two or three LEDs are disposed for each light source. In other embodiments, more than three LEDs may be disposed on one circuit board. When more than three LEDs are disposed, adjacent LEDs have different colors.

Figure 10:
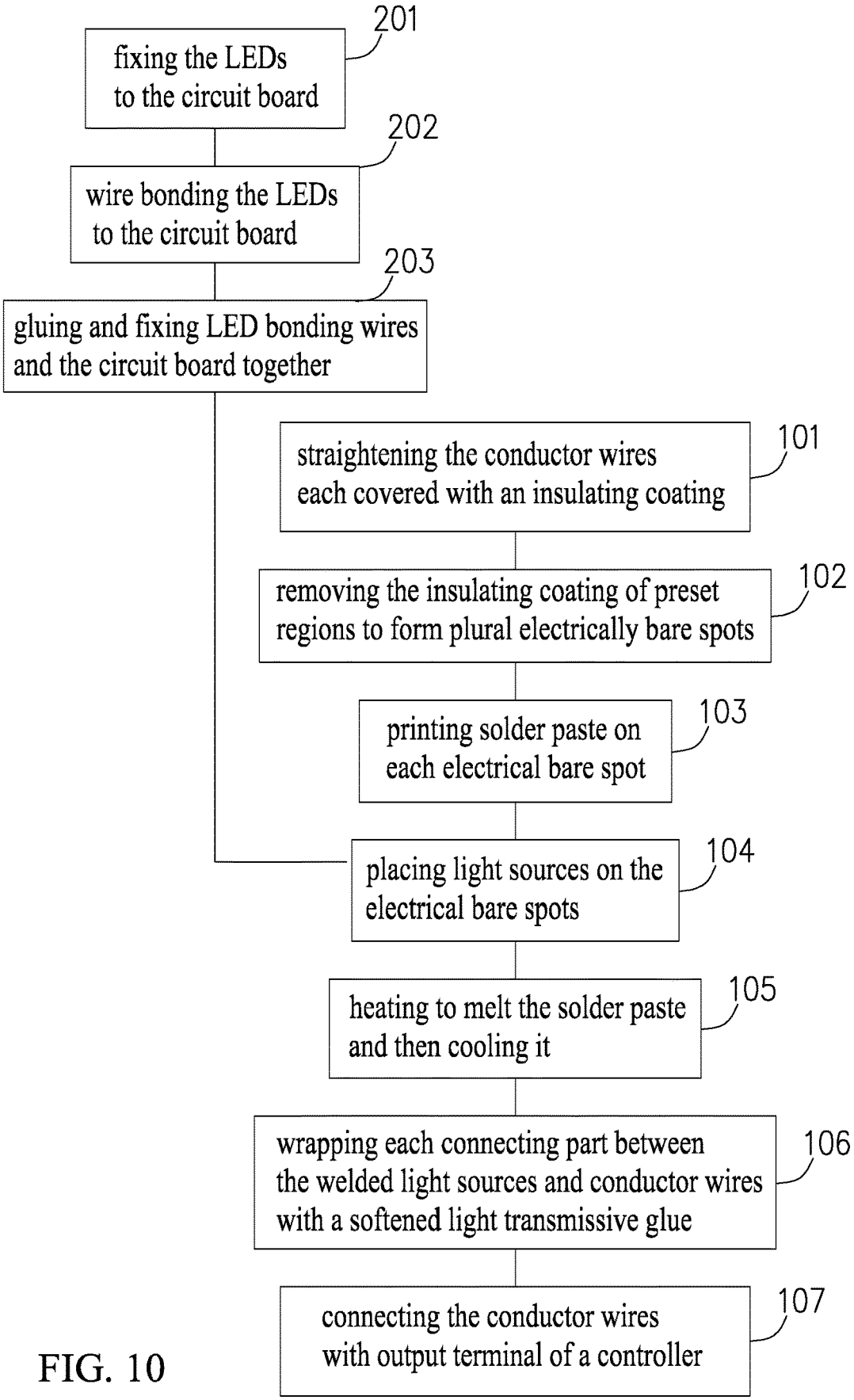
FIG. 10 is a flow chart showing a manufacturing method of a light string according to an embodiment of the present invention.

Referring to FIG. 10, the manufacturing method of the light string in the first embodiment may include the following steps.

S201, fixing the three LEDs to the circuit board.

S202, wire bonding the LEDs to the circuit board.

S203, gluing and fixing LED bonding wires and the circuit board together to form an independent light source.

S101, straightening the conductor wires each covered with an insulating coating, paralleling and aligning the enameled conductor wires 20 with preset spacing between each other.

S102, polishing plural preset regions of each conductor wire or removing the insulating coating of the preset regions by laser to form a plurality of electrical bare spots on each conductor wire; specifically, sequentially polishing the conductor wire in accordance with the arrangement of the light sources.

S103, printing solder paste on each electrical bare spot of the conductor wires; printing solder paste should be carried out as soon as possible after polishing to ensure good conductivity; the solder paste may be printed as soon as one preset region is polished, or the solder paste may be printed after three or more preset regions are polished.

S104, placing light sources on the electrical bare spots printed with the solder paste, so that each conductive strip of the circuit board of each light source contacts with the solder paste on one of the electrical bare spots; the final product should be one light source 30 fixed for each bare spot.

S105, heating to melt the solder paste and then cooling it, so that the solder paste welds the circuit boards of the light sources and the conductor wires together.

S106, wrapping the welded light source 30 and conductor wire 20 with the softened light transmissive glue 40, and curing the light transmissive glue 40 after wrapping the preset region of light source 30 and three conductor wires 20; the light transmissive glue 40 shall wrap the edge of the conductor wire 20 near the preset region, but does not need to wrap too much regions with the insulating layer.

S107, after connecting all the light sources 30, connecting the conductor wires with output terminal of a controller. The switch K1 on the controller 10 has been connected; in other embodiments, if the switch K1 of controller 10 is not connected yet, the switch K1 is reconnected. The controller 10 may also be connected to the power adapter 50 or plug to complete all assembly.

In the embodiment, the step S105 is implemented once one of the plurality of light sources is placed on the corresponding preset region printed with the solder paste in step S104.

In the above steps, steps S201 to S203 may be swapped with any step before step S104 without affecting the manufacturing process. The connection between the conductor wire and the controller in step S107 may also be completed before step S104.

The light string of the present invention adopts the conductor wire with an insulating layer. During the manufacture, the conductor wire may be straightened and polished to remove the corresponding insulating layer by using automation equipment, and then the solder may be printed, and the light source patch may be soldered on the copper wire. Finally, the light source and the portion connecting the light source and the conductor wire is sealed with glue, and the whole process can be automated with high production efficiency, without the steps of disconnecting and reconnecting the wires. The light source structure is ingeniously designed to facilitate automated production. The light string of the present invention only includes one controller, and no controller is required to be disposed in each light source, resulting in low cost in the case of performing functions such as discoloration and flashing. The junction between the light source and the conductor wire is wrapped with a light transmissive glue, which may be used as the light processing component under the condition of ensuring connection stability between the light source and the copper wire, so that the light string outputs softer light or has wider emission angle.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A light string, comprising:

at least two conductor wires each covered with an insulating coating comprising a plurality of holes acting as electrical bare spots;

a controller with an input terminal configured for connecting with an external power supply and an output terminal electrically connected with the at least two conductor wires; and a plurality of light sources each comprising:

one or more LEDs; and a circuit board having a first surface configured for fixing the one or more LEDs and a second surface defining at least two conductive strips across the second surface;

wherein the at least two conductive strips are physically and electrically non-connected, and are respectively soldered and electrically connected to the at least two conductor wires through the electrical bare spots, respectively;

wherein each connecting part between the conductive strips and the conductor wires is wrapped around by a light transmissive glue;

wherein two conductive ends of each LED are electrically connected to two of the at least two conductive strips.

2. The light string according to claim 1, wherein there are three conductor wires, and each light source comprises three LEDs, two of the three LEDs are in an inverse-parallel connection between a second conductor wire and a third conductor wire of the three conductor wires, and the remaining LED is connected between the third conductor wire and a first conductor wire of the three conductor wires.

3. The light string according to claim 2, wherein the controller comprises a control chip and six triodes, wherein three of the six triodes are PNP-type triodes, and the other three are NPN-type triodes; the control chip is provided with an input pin connected with a switch, and six output pins, and each output pin is connected with a base electrode of a corresponding one of the six triodes; the six triodes are divided into three groups, and each group comprises a PNP-type triode and an NPN-type triode, wherein a collector of the NPN-type triode is connected to a power supply terminal of the control chip, an emitter electrode thereof is electrically connected with a collector of the PNP-type triode and a corresponding one of the three conductor wires, and an emitter electrode of the PNP-type triode is connected to a ground terminal of the control chip.

4. The light string according to claim 2, wherein the controller comprises a control chip and six triodes, wherein three of the six triodes are PNP-type triodes, and the other three are NPN-type triodes; the control chip is provided with an input pin connected with a switch, and three output pins; the six triodes are divided into three groups, and each group comprises a PNP-type triode and an NPN-type triode, wherein a base electrode of the NPN-type triode is connected to a base electrode of the PNP-type triode and to a corresponding one of the three output pins of the control chip, a collector thereof is connected with a power supply terminal of the control chip, an emitter electrode thereof is electrically connected with a collector of the PNP-type triode and a corresponding one of the three conductor wires, and an emitter electrode of the PNP-type triode is connected to a ground terminal of the control chip.

5. The light string according to claim 2, wherein the second surface of the circuit board of each light source defines three conductive strips across the second surface, and each conductive strip is a bare copper region where a part of a copper-clad surface is exposed.

6. The light string according to claim 5, wherein the at least two conductor wires are insulated only with varnish to form the insulating coating.

7. The light string according to claim 1, wherein there are three conductor wires, and the plurality of light sources comprises:

plural first light sources each of which comprises a first LED, a second LED and a third LED, the first and the second LEDs are in an inverse-parallel connection between a second conductor wire and a third conductor wire of the three conductor wires, and the third LED is connected between the third conductor wire and a first conductor wire of the three conductor wires; and plural second light sources each of which comprises a fourth LED, a fifth LED and a sixth LED, the fourth and the fifth LEDs are in an inverse-parallel connection between the first conductor wire and the second conductor wire, and the sixth LED is connected between the third conductor wire and the first conductor wire;

wherein the third LED and the sixth LED are in an inverse-parallel connection between the third conductor wire and the first conductor wire;

wherein the plural first light sources and the plural second light sources are arranged alternately.

8. The light string according to claim 7, wherein the controller comprises a control chip and six triodes, wherein three of the six triodes are PNP-type triodes, and the other three are NPN-type triodes; the control chip is provided with an input pin connected with a switch, and six output pins, and each output pin is connected with a base electrode of a corresponding one of the six triodes; the six triodes are divided into three groups, and each group comprises a PNP-type triode and an NPN-type triode, wherein a collector of the NPN-type triode is connected to a power supply terminal of the control chip, an emitter electrode thereof is electrically connected with a collector of the PNP-type triode and a corresponding one of the three conductor wires, and an emitter electrode of the PNP-type triode is connected to a ground terminal of the control chip.

9. The light string according to claim 7, wherein the controller comprises a control chip and six triodes, wherein three of the six triodes are PNP-type triodes, and the other three are NPN-type triodes; the control chip is provided with an input pin connected with a switch, and three output pins; the six triodes are divided into three groups, and each group comprises a PNP-type triode and an NPN-type triode, wherein a base electrode of the NPN-type triode is connected to a base electrode of the PNP-type triode and to a corresponding one of the three output pins of the control chip, a collector thereof is connected with a power supply terminal of the control chip, an emitter electrode thereof is electrically connected with a collector of the PNP-type triode and a corresponding one of the three conductor wires, and an emitter electrode of the PNP-type triode is connected to a ground terminal of the control chip.

10. The light string according to claim 7, wherein each conductive strip of the circuit board of the light source is a bare copper region where a part of a copper-clad surface is exposed.

* * * * *